US011761449B2

(12) United States Patent
Hsieh et al.

(10) Patent No.: US 11,761,449 B2
(45) **Date of Patent: *Sep. 19, 2023**

(54) FAN MODULE

(71) Applicant: DELTA ELECTRONICS, INC., Taoyuan (TW)

(72) Inventors: Ming-Kai Hsieh, Taoyuan Hsien (TW); Ching-Hsiang Huang, Taoyuan (TW); Yi-Fang Chou, Taoyuan (TW); Po-Chun Wang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 206 days.

This patent is subject to a terminal disclaimer.

(21) Appl. No.: 17/039,430

(22) Filed: Sep. 30, 2020

(65) Prior Publication Data

US 2021/0018009 A1 Jan. 21, 2021

Related U.S. Application Data

(63) Continuation-in-part of application No. 15/916,832, filed on Mar. 9, 2018, now Pat. No. 10,935,033, (Continued)

(30) Foreign Application Priority Data

Jun. 30, 2015 (CN) ..... 201510372655.6

(51) Int. Cl.
*F04D 25/06* (2006.01)

(52) U.S. Cl.
CPC ..... *F04D 25/0693* (2013.01); *F04D 25/0613* (2013.01)

(58) Field of Classification Search
CPC ..... F04D 25/0693; H02K 5/225; H02K 3/50; H02K 3/51
See application file for complete search history.

(56) References Cited

U.S. PATENT DOCUMENTS 4,160,576 A * 7/1979 Vettori ..... F04D 29/646 439/527
5,189,327 A * 2/1993 Ootsuka ..... F04D 25/08 310/71

(Continued)

FOREIGN PATENT DOCUMENTS

JP H0715910 A * 1/1995
JP 2010077895 A * 4/2010

*Primary Examiner* — Justin D Seabe
(74) *Attorney, Agent, or Firm* — Muncy, Geissler, Olds & Lowe, P.C.

(57) ABSTRACT

A fan module comprises a frame, a wire-stopping structure, an impeller and a circuit board. The frame includes a frame wall, a base, a plurality of static blades and a connector. A wire groove formed on an outside of the frame wall to accommodate a wire. The static blades are radially connected to the base and the frame wall. The connector is formed on the outside of the frame wall and extended from one end of the wire groove to the base along one of the static blades. The connector includes a plurality of pins. The wire-stopping board is fixed to the frame wall to cover the wire groove. The impeller is disposed in the frame. The circuit board is disposed in the frame and located on the base. The circuit board includes a plurality of pin holes, and the pin holes are electrically connected to the pins.

14 Claims, 19 Drawing Sheets

Related U.S. Application Data which is a continuation of application No. 14/872,456, filed on Oct. 1, 2015, now abandoned.

(60) Provisional application No. 62/079,843, filed on Nov. 14, 2014.

(56) References Cited

U.S. PATENT DOCUMENTS

| | | | | |
|---|---|---|---|---|
| 6,942,471 | B2 | 9/2005 | Weisser | |
| 7,273,400 | B2 | 9/2007 | Horng et al. | |
| 7,791,880 | B2 * | 9/2010 | Chen | F04D 27/00 439/131 |
| 8,109,743 | B2 * | 2/2012 | Yoshida | F04D 25/0693 417/244 |
| 8,376,884 | B2 | 2/2013 | Spaggiari | |
| 9,163,637 | B2 | 10/2015 | Hsieh | |
| 10,408,216 | B2 | 9/2019 | Takeshita et al. | |
| 10,436,205 | B2 * | 10/2019 | Hamano | F04D 29/646 |
| 2007/0099459 | A1 | 5/2007 | Otsuki et al. | |
| 2007/0280840 | A1 | 12/2007 | Sugiyama et al. | |
| 2008/0153345 | A1 * | 6/2008 | Chen | H05K 7/20172 439/485 |
| 2014/0205430 | A1 | 7/2014 | Chang et al. | |
| 2014/0205451 | A1 * | 7/2014 | Zhu | F04D 25/0693 415/213.1 |
| 2014/0308121 | A1 * | 10/2014 | Tang | F04D 25/0613 415/220 |

* cited by examiner

FAN MODULE

CROSS REFERENCE TO RELATED APPLICATIONS

This application is a Continuation-in-Part of co-pending application Ser. No. 15/916,832, filed on Mar. 9, 2018, which is a continuation application of U.S. Ser. No. 14/872,456, filed Oct. 1, 2015, for which claims priority to U.S. provisional patent application with Ser. No. 62/079,843 filed on Nov. 14, 2014 and under 35 U.S.C. § 119(a) on Patent Application No(s). 201510372655.6 filed in People's Republic of China on Jun. 30, 2015. This and all other extrinsic materials discussed herein are incorporated by reference in their entirety.

BACKGROUND

Technical Field

The invention relates to a fan module.

Related Art

With the progress of technologies, the electronic devices become more and more efficient. However, if the heat generated by the electronic device is not properly dissipated, its performance becomes inferior and even the electronic device may burn out. Thus, the cooling device is a necessary equipment of the electronic device.

The fan module is a common active cooling device, and it usually includes a motor, an impeller, a circuit board and a frame. Generally, the motor is linked to the impeller and coupled to the circuit board, and the motor, the impeller and the circuit board are disposed in the frame. When starting the fan, an independent connector is connected to the circuit board by the welding wire arranged manually to pass through the wire-arrangement groove of the frame and welding to the pads of the circuit board manually. Then, the connector of the power supply electrically connected to the connector which connected with the circuit board. The power supply provides electrical power by the connector and the welding wire for the circuit board to drive the motor to operate and accordingly rotate the fan. However, the welding wires should be arranged manually to pass through the wire-arrangement groove of the frame and then welding to the pads of the circuit board manually. Thus, the manufacturing process and the testing process of the fan module would be complicated and the cost would be higher.

Moreover, as to the fan module 3 in FIG. 7, if these welding wires connected to the circuit board are not arranged properly and disordered in the space utilized by the wire-arrangement groove 31 and the wire groove 32 of the fan module 3, dusts is likely to be adhered to the welding wires and causes that the temperature of the welding wires raises. Thus, the performance of the fan is impacted. Besides, if the fan module 3 is installed in a small space of an apparatus, the welding wires may interfere with the apparatus so possibly it is stuck or breaks. As a result, the fan module 3 could not be successfully installed and operated.

Accordingly, it is desired to provide a fan module that can arrange the wires easier so as to prevent the wire interfere with external elements or wear, and cause the installation, the manufacturing process and the testing process of the fan module be complicated.

SUMMARY

In view of the foregoing objectives, the purpose of this invention is to provide a fan module. Compared with the conventional art, the design of the connector and the circuit board of the fan module of this invention can achieve the effects that let the arrangement of the wires be easier. Thus, the manufacturing process and the testing process of the fan module could be automatically so as to decrease the cost.

To achieve the above objective, this invention provides a fan module comprises a frame, a wire-stopping board, an impeller and a circuit board. The frame includes a frame wall, a base, a plurality of static blades and a connector. A wire groove is formed on an outside of the frame wall to accommodate at least one wire. The static blades are radially connected to the base and the frame wall, and located between the base and the frame wall. The connector is formed on the outside of the frame wall and extended from one end of the wire groove to the base along one of the static blades. The connector includes a plurality of pins. The wire-stopping board is fixed to the frame wall to cover the wire groove. The impeller is disposed in the frame. The circuit board is disposed in the frame and located on the base. The circuit board includes a plurality of pin holes. The pin holes are electrically connected to the pins.

In one embodiment, a shape of the circuit board is corresponding to a shape of the base.

In one embodiment, the circuit board further includes a protruding portion. The protruding portion is corresponding to the static blade which the connector is extended along. The pin holes are located at the protruding portion.

In one embodiment, the frame further includes at least one fastening portion and at least one positioning portion. The fastening portion is disposed on one side of the wire groove. The positioning portion is disposed on the other side of the wire groove.

In one embodiment, the frame further includes at least one fastening portion and at least one positioning portion. The fastening portion is disposed on one end of the wire groove. The positioning portion is disposed on the other end of the wire groove.

In one embodiment, the wire-stopping board includes at least one first combination portion and at least one second combination portion. The at least one first combination portion is engaged with the at least one fastening portion. The at least one second combination portion is engaged with the at least one positioning portion.

In one embodiment, the at least one fastening portion and the at least one positioning portion are protruding blocks, and the at least one first combination portion and the at least one second combination portion are indentations.

In one embodiment, the at least one fastening portion and the at least one positioning portion are interlaced disposed.

In one embodiment, the at least one fastening portion and the at least one positioning portion are indentations, and the at least one first combination portion and the at least one second combination portion are protruding blocks.

In one embodiment, the at least one fastening portion is oppositely disposed with the at least one positioning portion.

In one embodiment, the wire-stopping board pivots on a pivot at the fastening portion or the positioning portion.

In one embodiment, the fastening portion and the positioning portion are chutes or protruding blocks. The wire-stopping board is sliding to fix to the frame wall and held by the fastening portion and the positioning portion.

In one embodiment, the frame further includes a wire-guiding structure which is disposed at the other end of the wire groove.

To achieve the above objective, this invention also provides a fan module comprises a frame, an impeller and a circuit board. The frame includes a frame wall, a base, a plurality of static blades and a connector. The static blades are radially connected to the base and the frame wall, and located between the base and the frame wall. The connector is formed on an outside of the frame wall and extended from the frame wall to the base along one of the static blades. The connector includes a plurality of pins. The impeller is disposed in the frame. The circuit board is disposed in the frame and located on the base. The circuit board includes a plurality of pin holes. The pin holes are electrically connected to the pins.

In one embodiment, a shape of the circuit board is corresponding to a shape of the base.

In one embodiment, the circuit board further includes a protruding portion. The protruding portion is corresponding to the static blade which the connector is extended along, and the pin holes are located at the protruding portion.

As mentioned above, as to the fan module, because the connector is directly formed on the outside of the frame wall and electrically connected to the circuit board, the arrangement of the wires would be easier. Moreover, the wire-stopping board covers the wire groove of the frame, so as to the wire in the wire groove would not protrude from the frame wall. Thus, the wire would not interfere with external elements or wear, and it is easier to install the fan module. In some embodiments, the wire-stopping board may further cover and shield the connector of the frame so as to avoid the air leak occurring in the connector and improve characteristics of the air pressure and air volume. Further, the manufacturing process and the testing process of the fan module in this invention could be automatically and decreasing the cost.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1A:
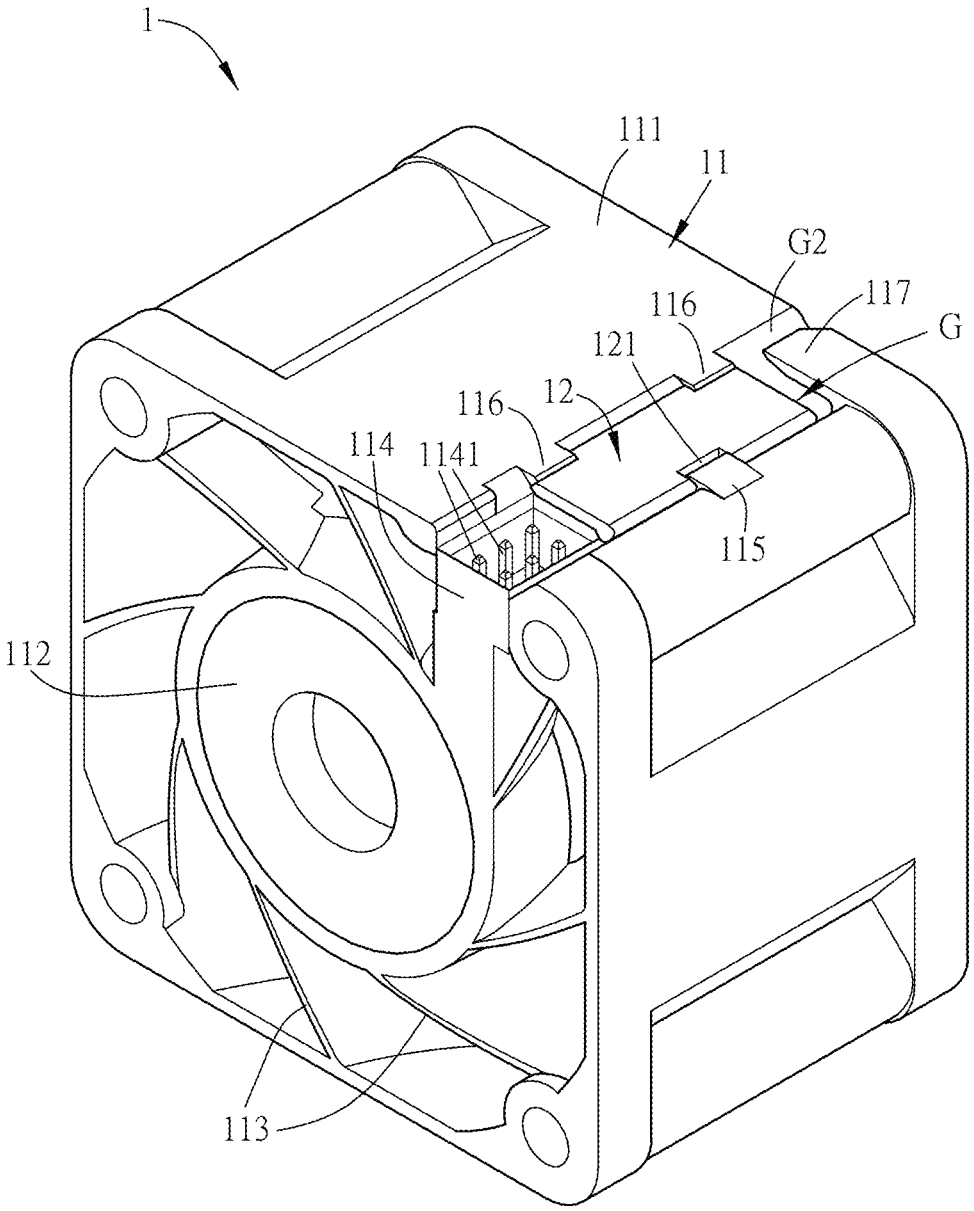
FIG. 1A is a perspective schematic diagram showing a fan module according to the first embodiment of the invention.
Figure 1B:
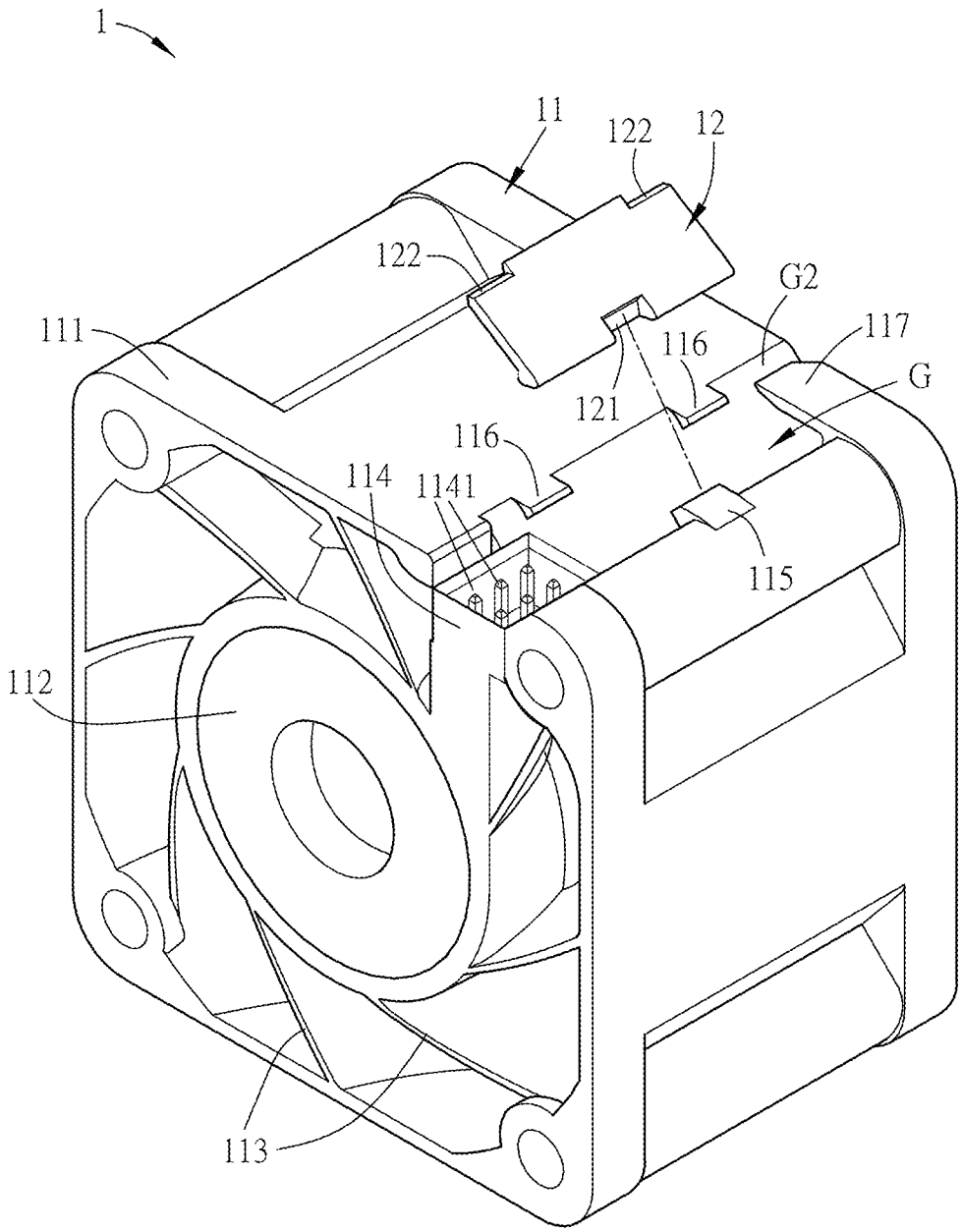
FIG. 1B is an exploded view of the fan module in FIG. 1A.
Figure 1C:
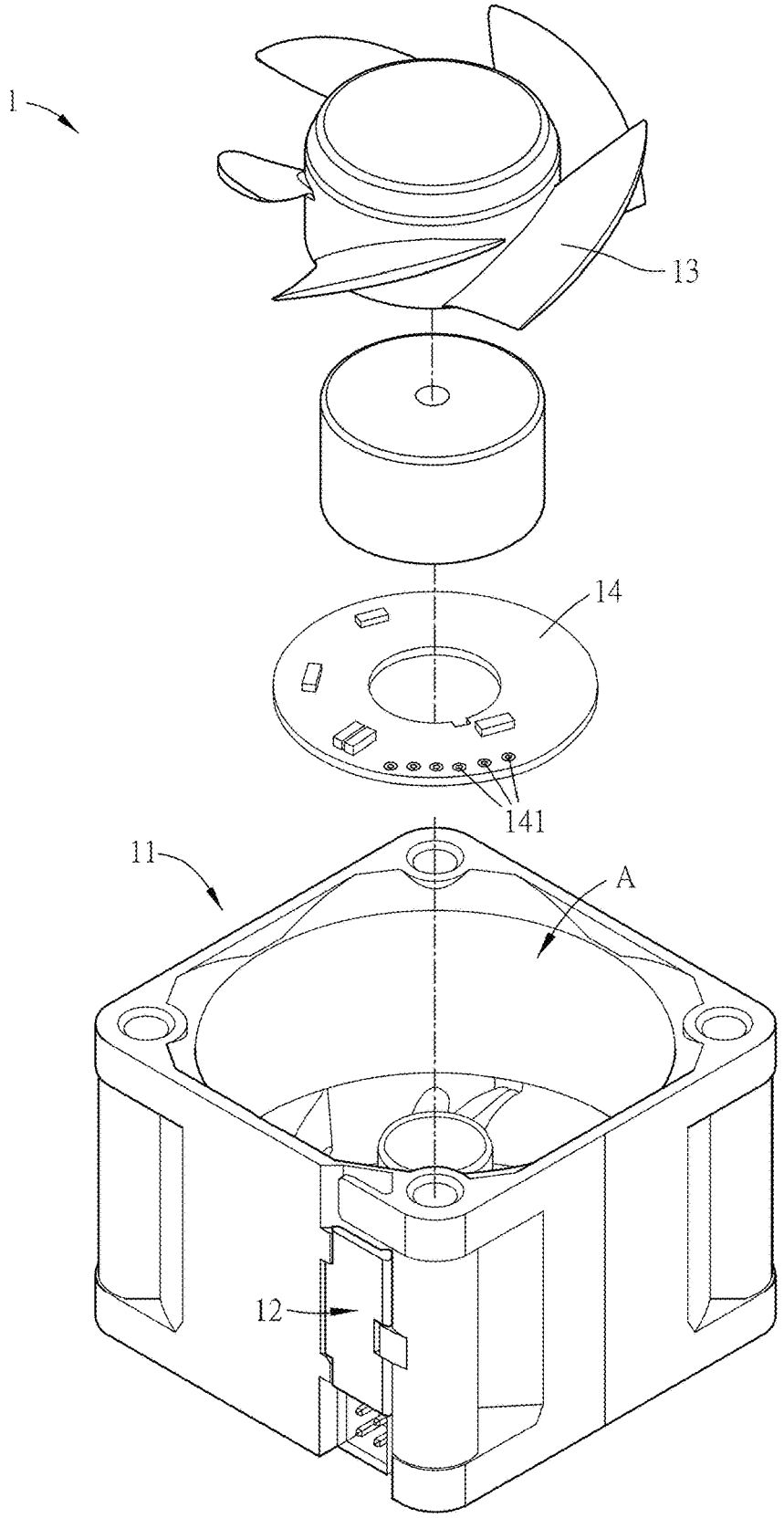
FIG. 1C is another exploded view of the fan module in FIG. 1A.

FIG. 1A is a perspective schematic diagram showing a fan module according to the first embodiment of the invention, FIG. 1B is an exploded view of the fan module in FIG. 1A, and FIG. 1C is another exploded view of the fan module in FIG. 1A. Referring to FIG. 1A, FIG. 1B and FIG. 1C, the fan module 1 comprises a frame 11, a wire-stopping board 12, an impeller 13 and a circuit board 14. The frame 11 includes a frame wall 111, a base 112, a plurality of static blades 113 and a connector 114. The static blades 113 are radially connected to the base 112 and the frame wall 111, and located between the base 112 and the frame wall 111. The outside of the frame wall 111 and the inside of the frame wall 111 are different shapes. For example, in the frame 11, the outside of the frame wall 111 is roughly like a square ring, the inside of the frame wall 111 is roughly like a circular ring, and the frame 11 includes four corners. The impeller 13 is disposed in the frame 11. In details, as shown in FIG. 1C, the frame wall 111 forms an accommodation space A to accommodate the impeller 13, the circuit board 14 and the motor or other elements so as to form a fan module 1. For the sake of clarity, the impeller 13 is not illustrated in FIG. 1D and FIG. 1E, and the motor or other elements mentioned above are not illustrated in all the figures.

Figure 1D:
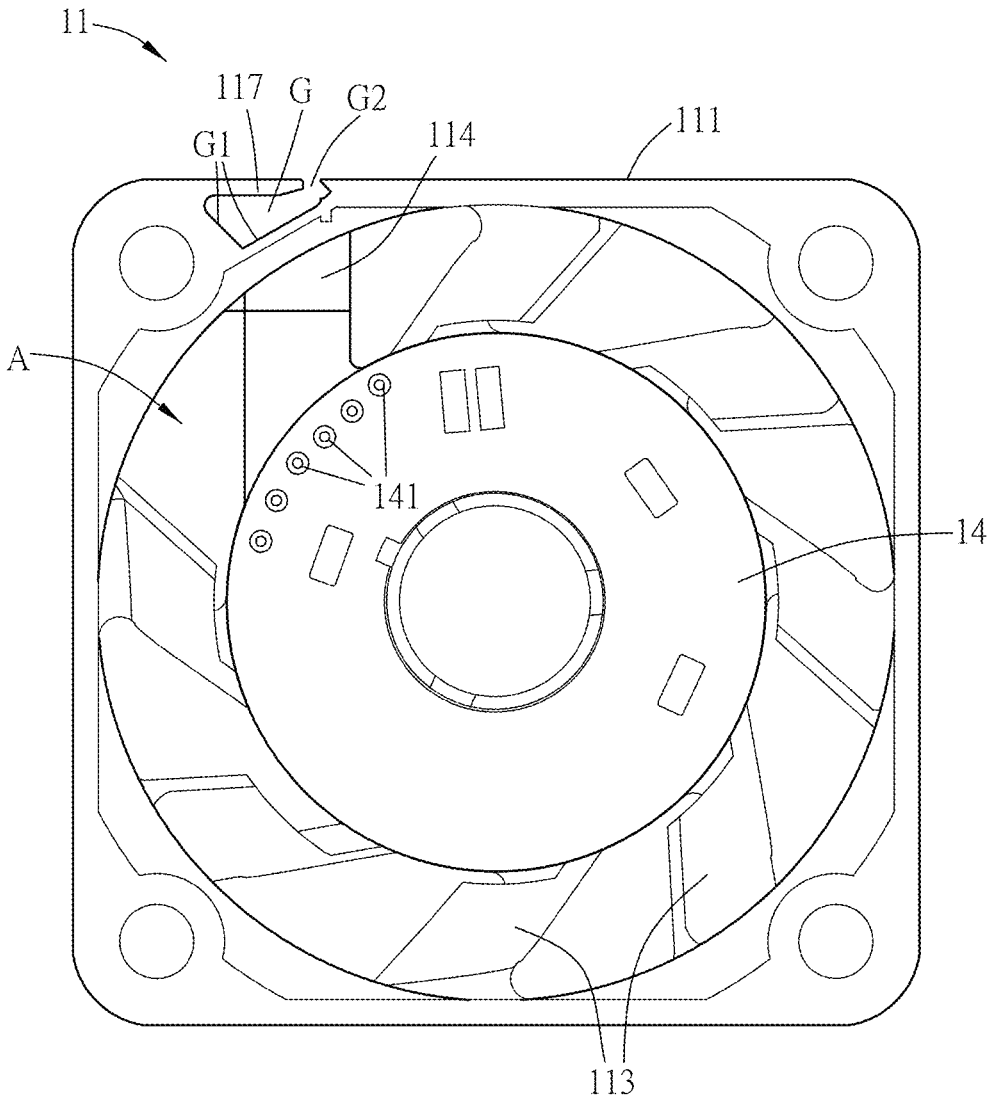
FIG. 1D is a lateral view of the fan module in FIG. 1A at axial viewing angle.
Figure 1E:
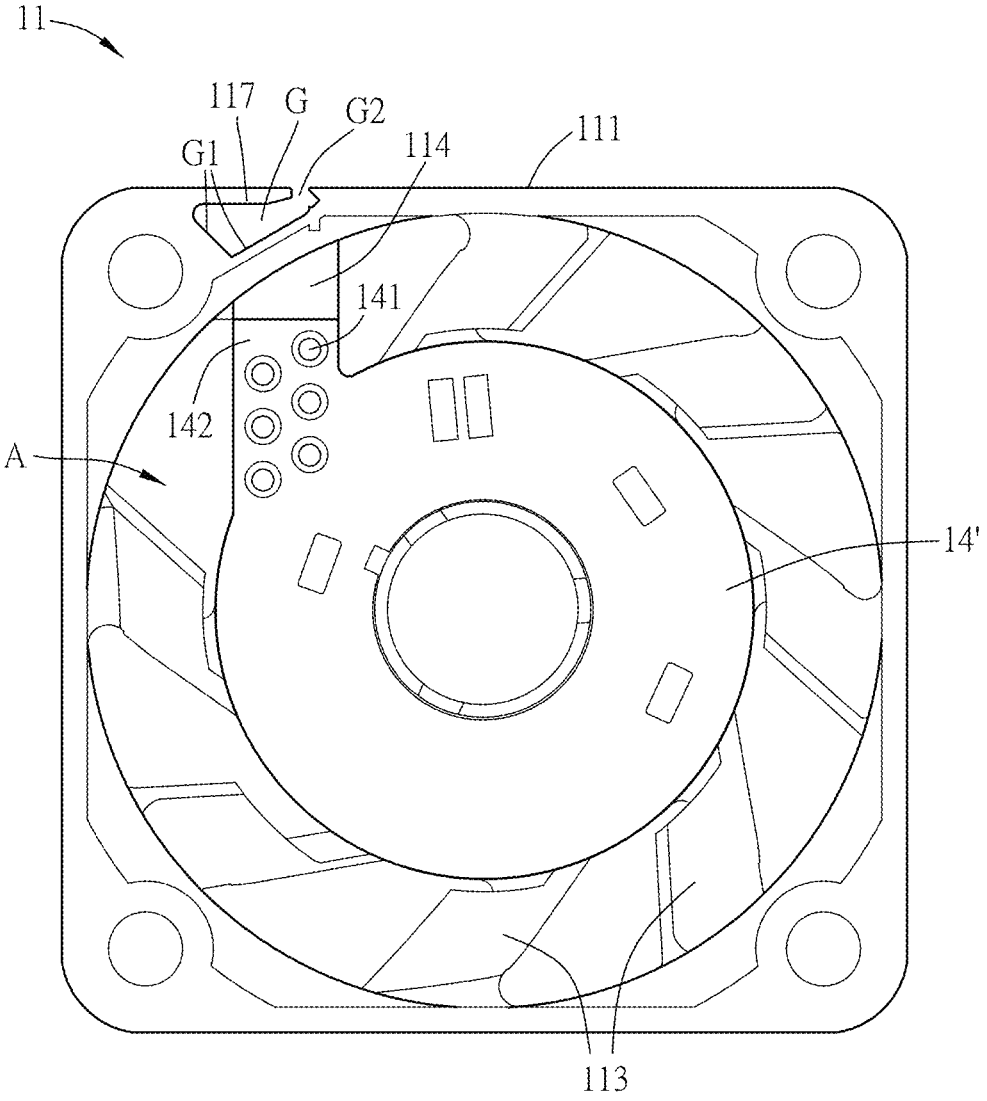
FIG. 1E is a lateral view of another embodiment of the fan module in FIG. 1A at axial viewing angle.
Figure 1F:
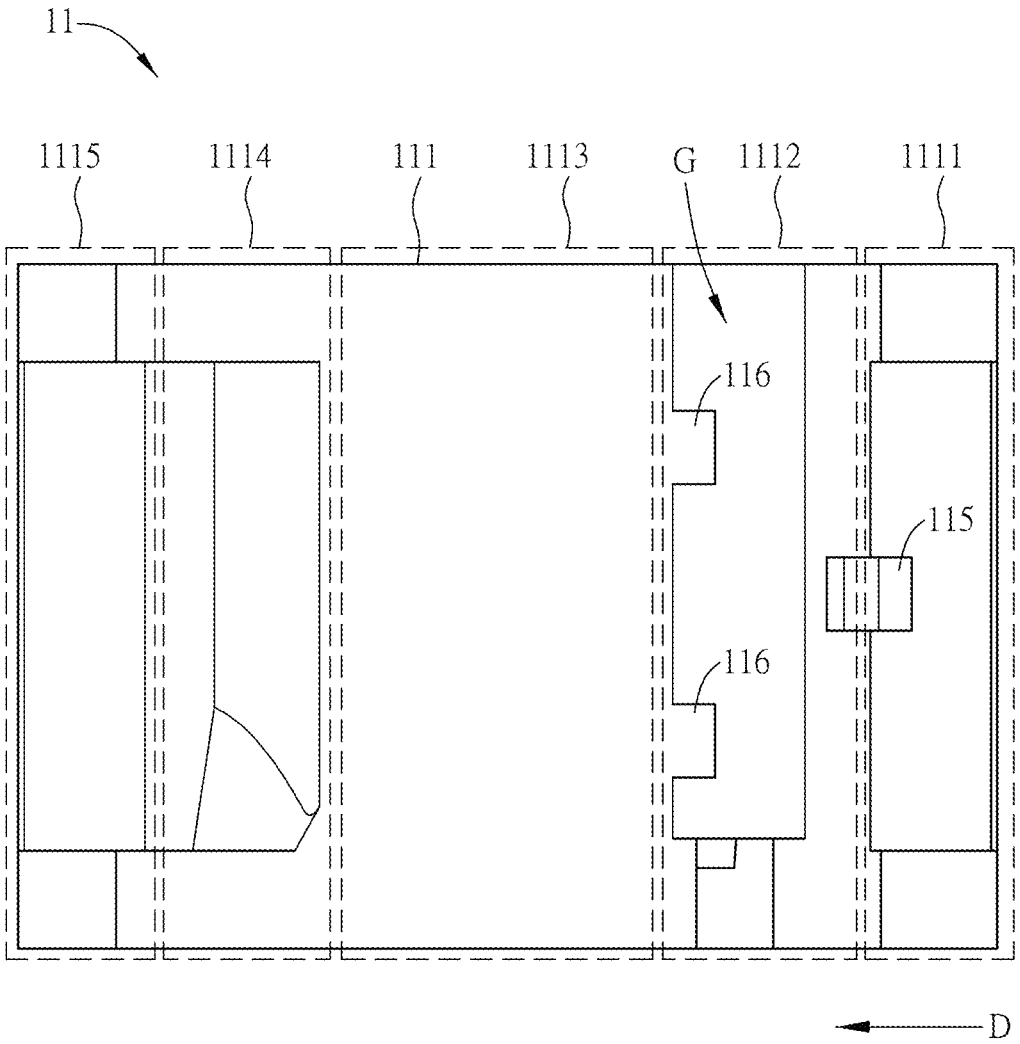
FIG. 1F is a lateral view of the fan module in FIG. 1A at radial viewing angle.

FIG. 1F is a lateral view of the fan module in FIG. 1A at radial viewing angle. Referring to FIG. 1F, the frame wall 111 is sequentially divided into a first side section 1111, a first mid section 1112, a central section 1113, a second mid section 1114 and a second side section 1115 in a first direction D. The extension direction of the major axis of the central section 1113 is parallel to the central axis of the frame 11, and the first direction D is perpendicular to the extension direction of the major axis of the central section 1113.

FIG. 1D is a lateral view of the fan module in FIG. 1A at axial viewing angle. Referring to FIG. 1A, FIG. 1D and FIG. 1F, a wire groove G is formed on an outside of the frame wall 111 to accommodate at least one wire. In details, the wire groove G is formed on the first mid section 1112 to accommodate at least one wire which may be electrically connected to the circuit board 14 mentioned above and the power supply. The wire groove G may be an arc groove face, or formed with two inclined planes, or it may be formed with two opposite lateral surfaces and a bottom surface. However, the recessed shape of the wire groove G is not limited. In the embodiment in FIG. 1D, the wire groove G has two lateral surfaces G1 disposed oppositely, and each lateral surface G1 and the frame wall 111 have an included obtuse angle.

Referring to FIG. 1B and FIG. 1D, The connector 114 is formed on the outside of the frame wall 111 and extended from one end of the wire groove G to the base 112 along one of the static blades 113. The connector 114 includes a plurality of pins 1141. The pins 1141 are exposed out of the frame 11 to facilitate the connection with the terminals of the wires. The connector 114 and the power supply are electrically connected by the connection between the wires and pins 1141. The connector 114 would be formed by, for example, but not limited to injection molding with the frame.

Referring to FIG. 1A, FIG. 1C and FIG. 1D, the circuit board 14 is disposed in the frame 11 and located on the base 112. The circuit board 14 includes a plurality of pin holes 141, the pin holes 141 are electrically connected to the pins 1141. As show in FIG. 1D, in this embodiment, a shape of the circuit board 14 is corresponding to a shape of the base 112.

FIG. 1E is a lateral view of another embodiment of the fan module in FIG. 1A at axial viewing angle. Referring to FIG. 1A and FIG. 1E, in another embodiment, the shape of the circuit board 14' is corresponding to the shape of the base 112, and the circuit board 14' further includes a protruding portion 142. The protruding portion 142 is corresponding to the static blade 113 which the connector 114 is extended along, and the pin holes 141 are located at the protruding portion 142. The pin holes 141 and the pins 1141 are electrically connected by, for example but not limited to, directly contacting, or welding. In details, the pins 1141 are disposed in the connector 114 and extended along the connector 114 to the circuit board 14 until the pins 1141 reach the position of the pin holes 141. Then, the terminals of the pins 1141 are welded with the pin holes 141, and thus the connector 114 is electrically connected to the circuit board 14.

Referring to FIG. 1A, FIG. 1B and FIG. 1D, the frame 11 further includes at least one fastening portion 115 and at least one positioning portion 116. The fastening portion 115 is disposed on one side of the wire groove G, and the positioning portion 116 is disposed on the other side of the wire groove G. In this embodiment, the fastening portion 115 and the positioning portion 116 are respectively located at different lateral surfaces G1, and respectively extend from the frame wall 111 to each other. In this embodiment, the frame 11 includes one fastening portion 115 and two positioning portions 116 which are interlaced disposed for example. There is an acute included angle between the fastening portion 115 and the lateral surface G1, and there is another acute included angle between the positioning portion 116 and the other lateral surface G1, too.

In this embodiment, the wire-stopping board 12 is roughly like a rectangle board which corresponds to the fastening portion 115 and the positioning portions 116, so the wire-stopping board 12 is held and fixed by the fastening portion 115 and the positioning portions 116 on the frame wall 111 to firmly cover the wire groove G. Moreover, the wire-stopping board 12 is detachably connected to the fastening portion 115 and the positioning portion 116. The fastening portion 115 and the positioning portions 116 interfere with the wire-stopping board 12, so the wire-stopping board 12 is located in the wire groove G and not exposed from the frame wall 111. Therefore, the wire-stopping board 12 could be sandwiched between the fastening portion 115 and the lateral surface G1 to connect to the fastening portion 115. Similarly, the other side of the wire-stopping board 12 could also be sandwiched between the positioning portions 116 and the other lateral surface G1, so the wire-stopping board 12 can firmly cover the wire groove G and it as well as the frame 11 would not be separated. Moreover, the periphery of the wire-stopping board 12 may have fillets or chamfers for assembly of the wire-stopping board 12 and the frame 11.

The wire-stopping board 12 has at least one first combination portion 121 and at least one second combination portion 122. The at least one first combination portion 121 is engaged with the at least one fastening portion 115. The at least one second combination portion 122 is engaged with the at least one positioning portions 116. As shown in FIG. 1B, in this embodiment, the frame 11 has one fastening portion 115 and two positioning portions 116. The fastening portion 115 and the positioning portions 116 are protruding blocks. Correspondingly, the wire-stopping board 12 has one first combination portion 121 and two second combination portions 122. The first combination portion 121 is located at one side corresponding to the fastening portion 115. The second combination portions 122 are located at the other side opposite to the first combination portion 121. The second combination portions 122 are disposed corresponding to the positioning portions 116. The first combination portion 121 and the second combination portions 122 are indentations. The protruding blocks (the fastening portion 115/the positioning portions 116) engage with the indentations (the first combination portion 121/the second combination portions 122).

Figure 1G:
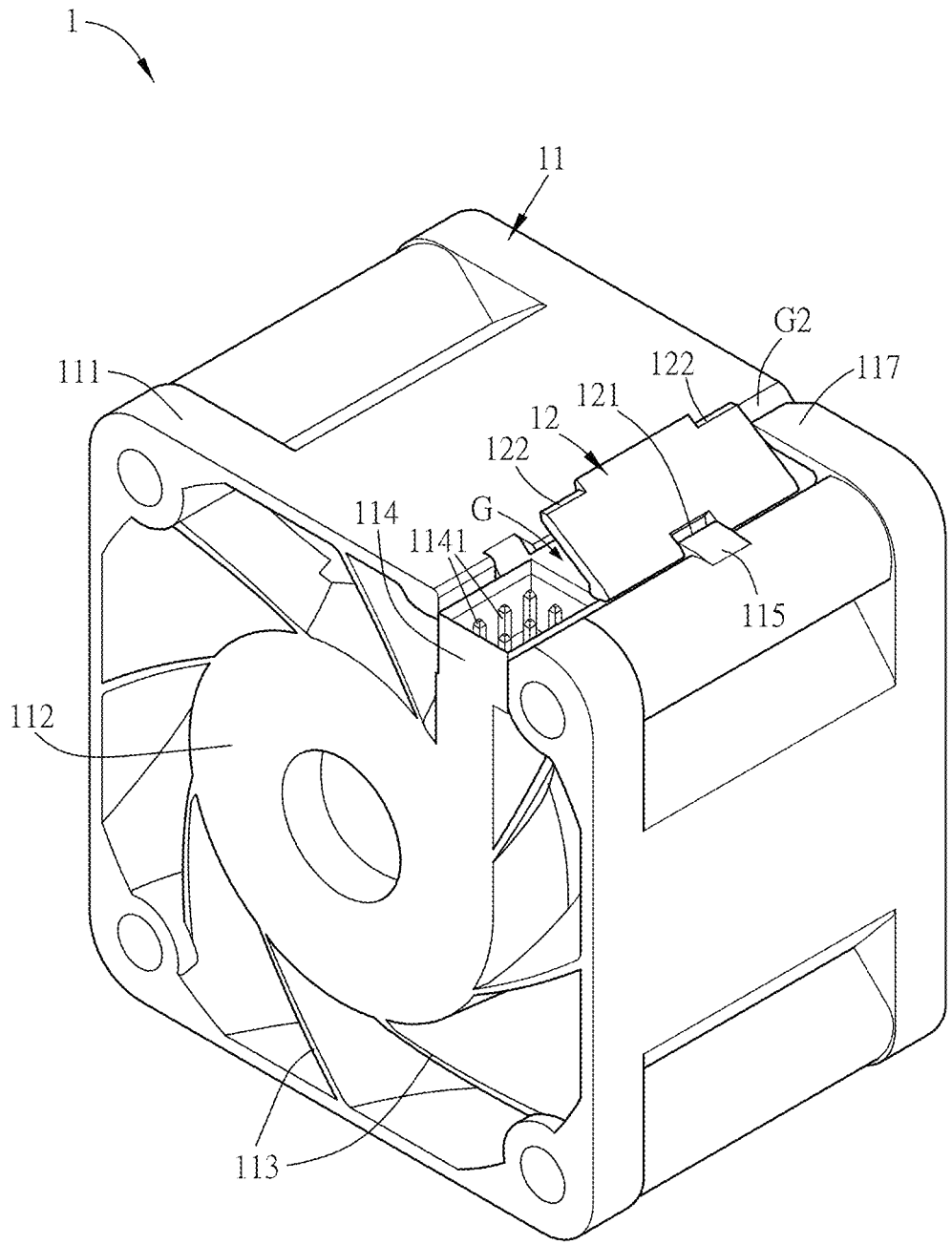
FIG. 1G is a schematic diagram showing the assembly process of the wire-stopping board of the fan module in FIG. 1A.
Figure 1H:
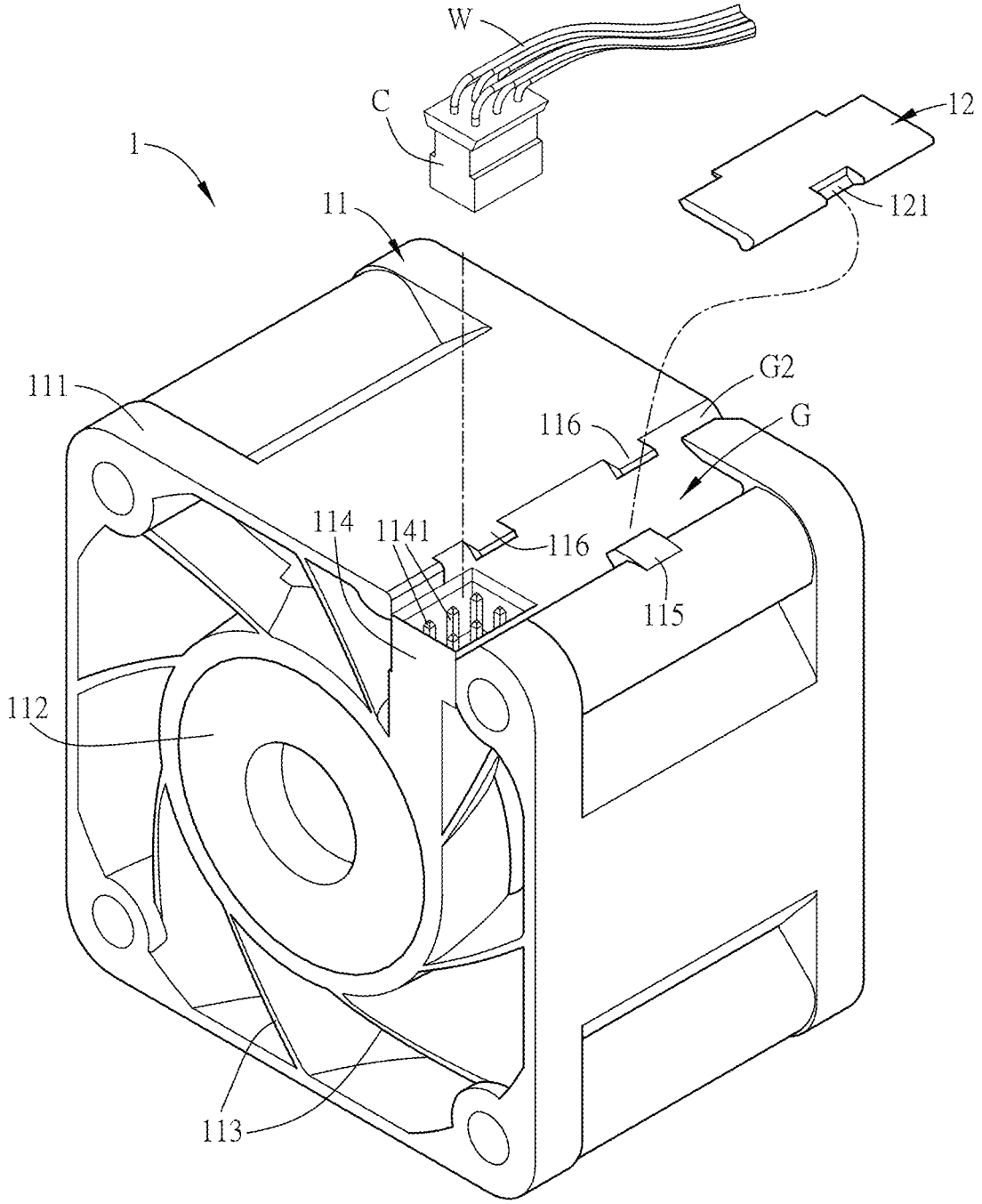
FIG. 1H is a perspective diagram showing the assembly process of the fan module in FIG. 1A with a connector of the power supply.
Figure 1I:
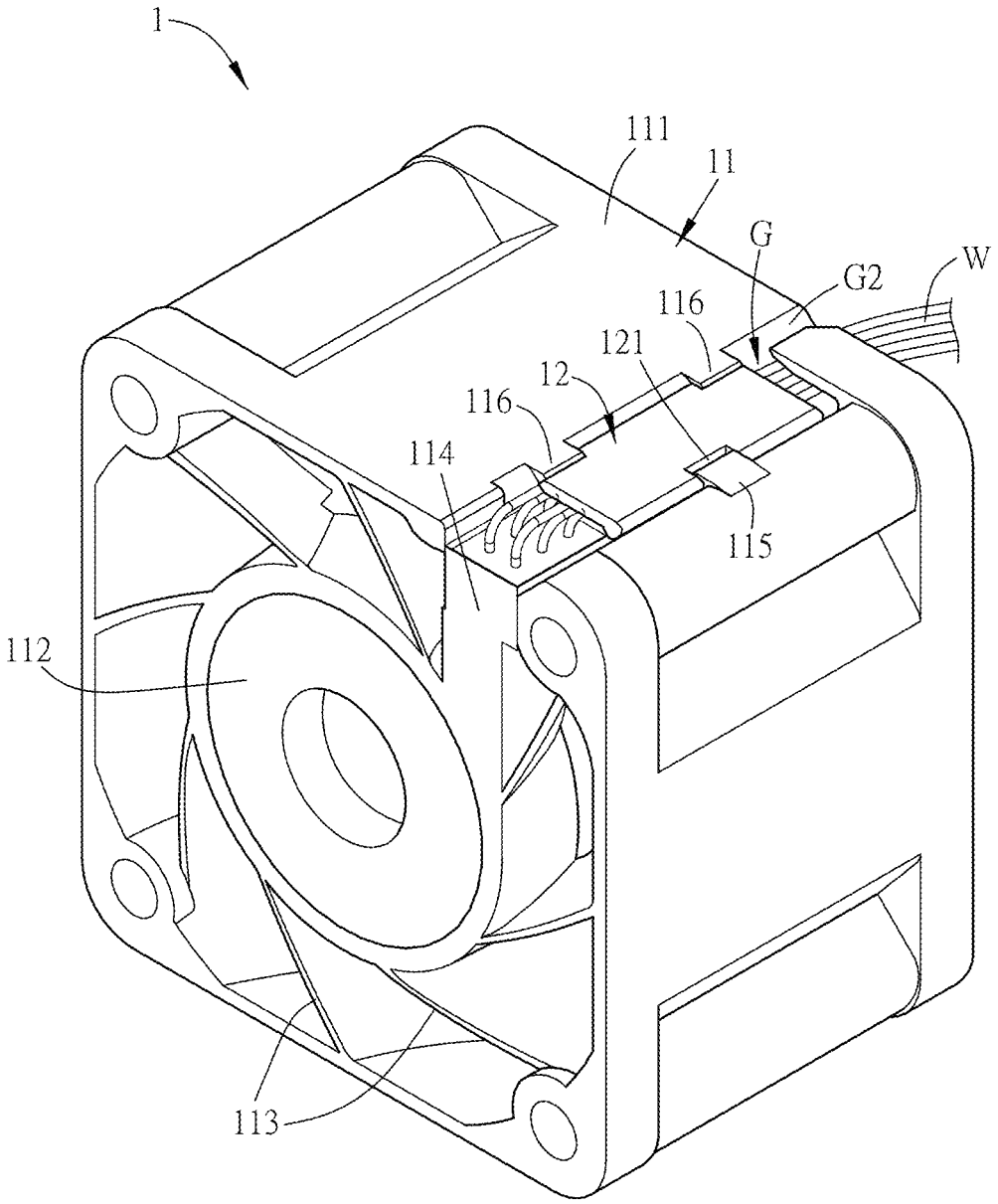
FIG. 1I is a perspective diagram showing the combination of the fan module and the connector of the power supply in FIG. 1H.

FIG. 1G is a schematic diagram showing the assembly process of the wire-stopping board of the fan module in FIG. 1A. FIG. 1H is a schematic diagram showing the assembly process of the fan module in FIG. 1A with a connector of the power supply. FIG. 1I is a perspective diagram showing the combination of the fan module and the connector of the power supply in FIG. 1H. Referring to FIG. 1H, when assembling with a connector C of a power supply, the connector C of the power supply is inserted into the connector 114 of the fan module 1 first. Then, as shown in FIG. 1G, the first combination portion 121 of the wire-stopping board 12 may correspondingly abuts the fastening portion 115. The abutted point acts as the pivot to rotate the wire-stopping board 12 toward the wire groove G. The wire-stopping board 12 is pushed in underneath the positioning portions 116. At the moment, the wire-stopping board 12 is fixed by the fastening portion 115 and the positioning portions 116 and covers the wire groove G. Therefore, as to the fan module 1 shown in FIG. 1I, the wire W in the wire groove G would not protrude from the frame wall 111 so as to ensure that the wire W would not interfere with external elements or wear. Thus, it is easier to install the fan module 1. The fan module 1 combined with a power supply which includes a connector C and wire W is merely for example. The fan module 1 also could directly combine with a power supply or a connector of a system which does not have wires, and it is not limited thereto.

Besides, in some embodiments, two opposite blind holes may be disposed on the fastening portion 115, and the line connecting the blind holes is parallel to the axial of the fan module 1 for example. Two bumps corresponding to the blind holes are disposed on the wire-stopping board 12. Here, the wire-stopping board 12 and the fastening portion 115 may be assembled by the bumps and the blind holes, so the assembled part of the wire-stopping board 12 is like axial rotation to form a pivot structure. The disposition or location of the blind holes or the bumps may be varied, the above description is for example.

Referring to FIG. 1B and FIG. 1D, the frame 11 may further includes a wire-guiding structure 117 which leads the wire into the wire groove G or leads the wire out of the wire groove G. In the embodiment, the wire-guiding structure 117 is disposed at the other end of the wire groove G. The other end of the wire groove G is opposite to the one end which formed the connector 114. For example, the wire-guiding structure 117 is a structure formed from the side of the wire groove G and extending to another side of the wire groove G, and it is a gap G2 between the another side of the wire groove G and the wire-guiding structure 117. Here, the wire-guiding structure 117 forms a holding space communicating with the wire groove G, so the wire can pass through the gap G2 to be held in the holding space and accordingly fixed. It is beneficial to adjust and fix the outlet direction of the wire.

Figure 2A:
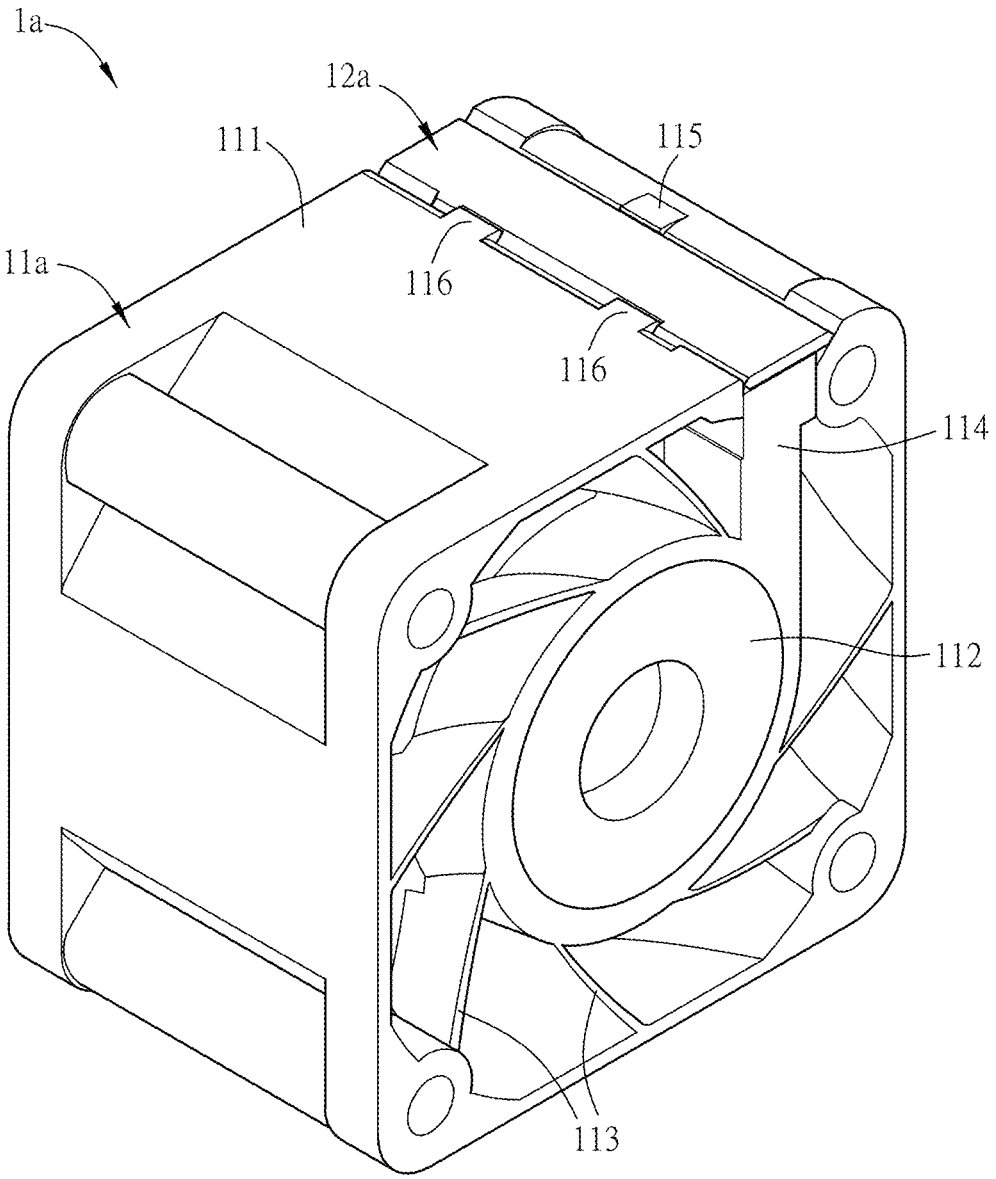
FIG. 2A is a perspective schematic diagram showing a fan module according to the second embodiment of the invention.
Figure 2B:
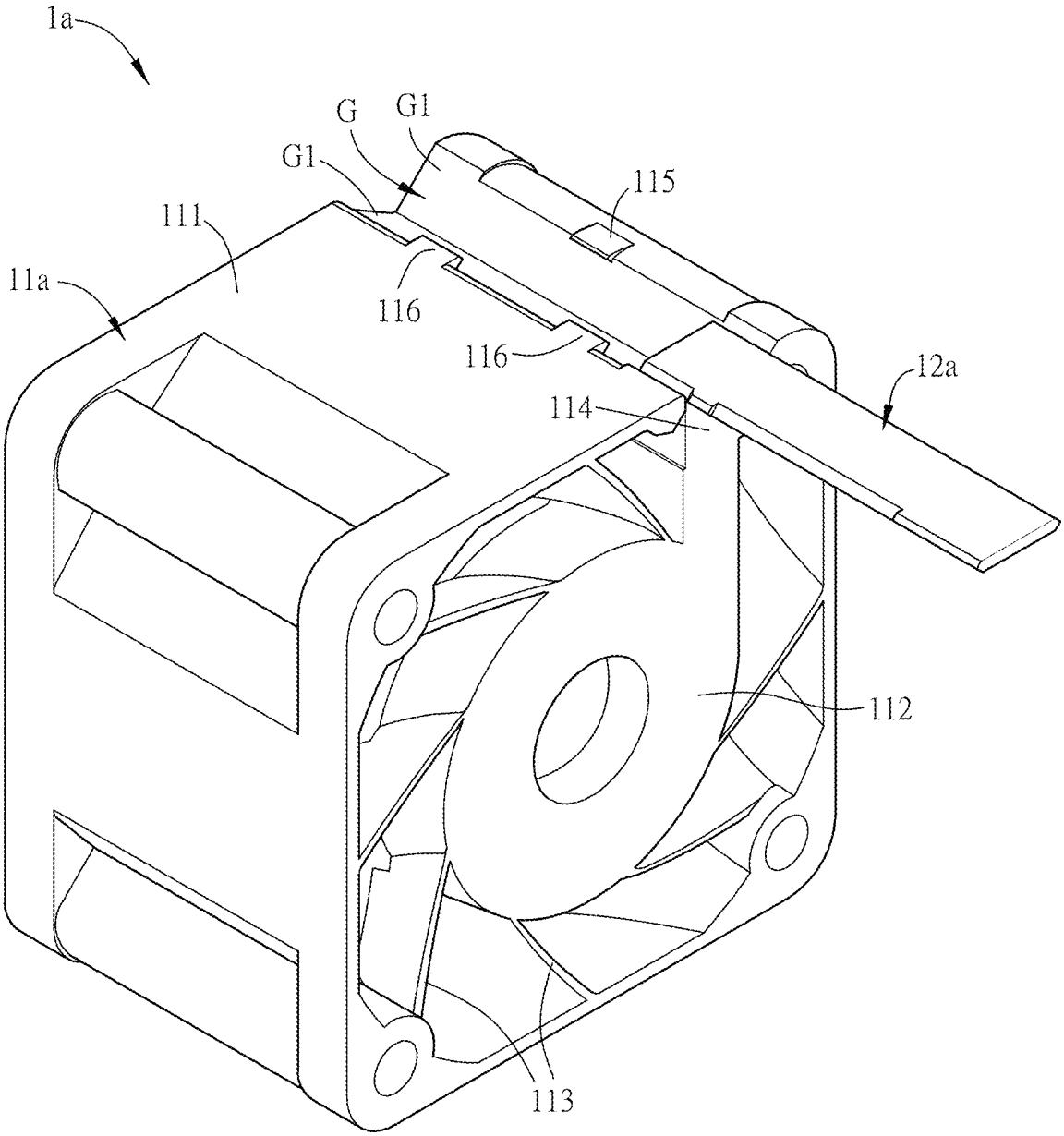
FIG. 2B is an exploded view of the fan module in FIG. 2A.

FIG. 2A is a perspective schematic diagram showing a fan module according to the second embodiment of the invention, and FIG. 2B is an exploded view of the fan module in FIG. 2A. Referring to FIG. 2A and FIG. 2B, in the embodiment, the frame 11*a* of the fan module 1*a* does not have the wire-guiding structure 117 in the previous embodiment. The length of the wire-stopping board 12*a* is equal to the length of the wire groove G. Therefore, in addition to completely covering the wire groove G, the wire-stopping board 12*a* may further cover and shield the connector 114 so as to avoid the air leak occurring in the connector 114 and improve characteristics of the air pressure and air volume. As to assembly, the wire-stopping board 12*a* may be install on the frame 11*a* by fastening like the first embodiment, or it may be placed in from one end of the wire groove G and then slid up to a desire location (as shown in FIG. 2B).

Figure 3A:
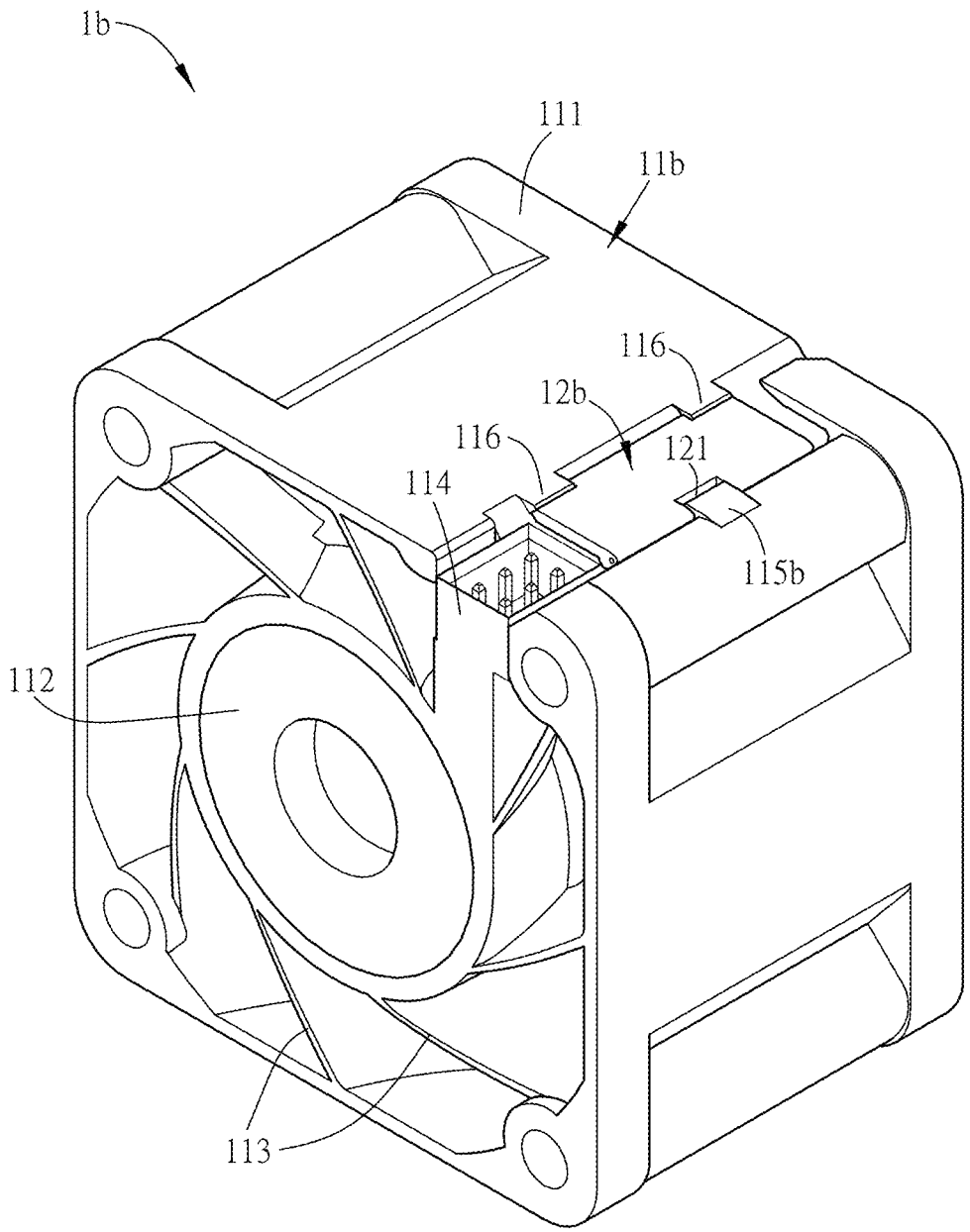
FIG. 3A is a perspective schematic diagram showing a fan module according to the third embodiment of the invention.
Figure 3B:
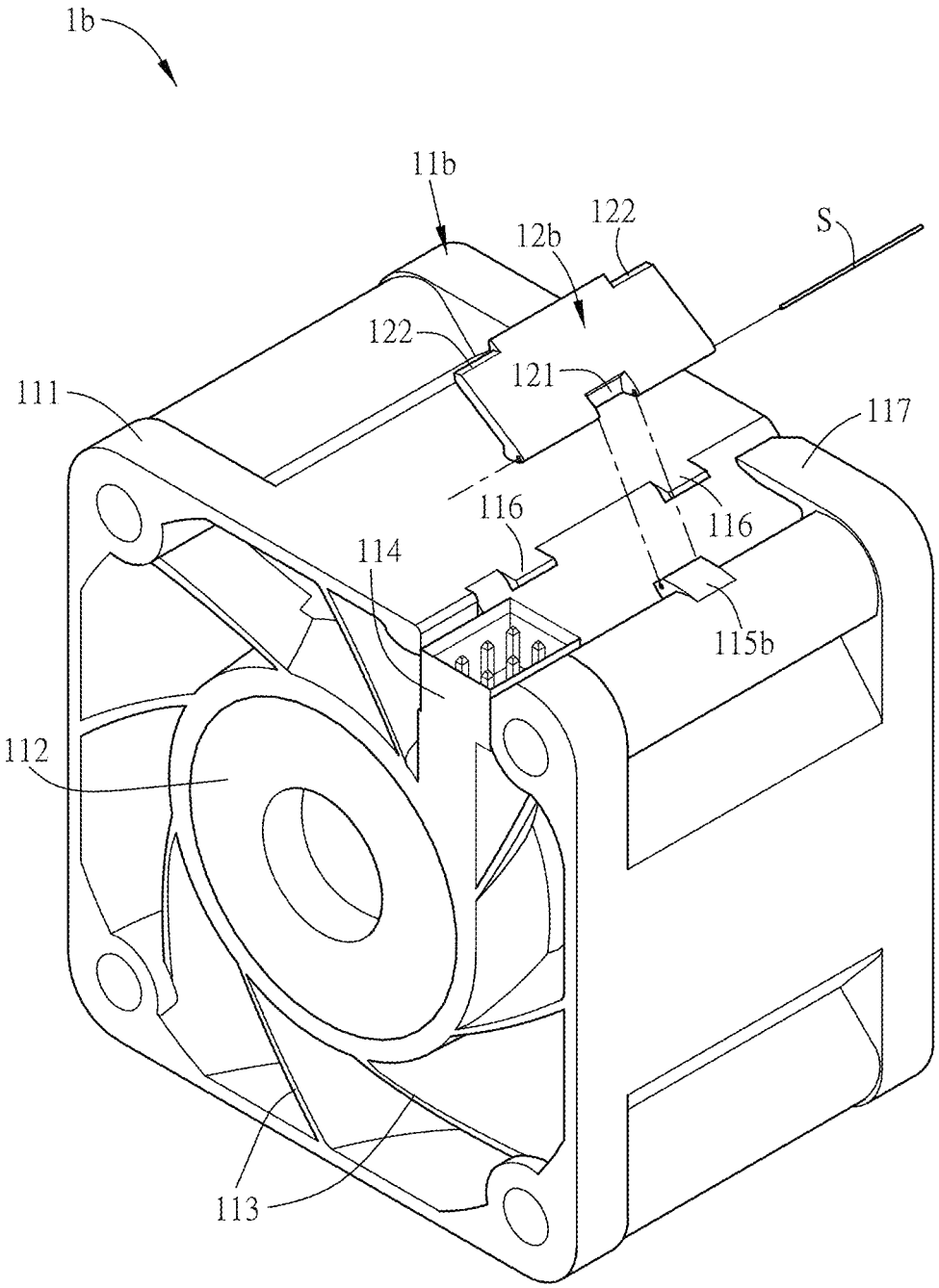
FIG. 3B is an exploded view of the fan module in FIG. 3A.

FIG. 3A is a perspective schematic diagram showing a fan module according to the third embodiment of the invention, and FIG. 3B is an exploded view of the fan module in FIG. 3A. Referring to FIG. 3A, this embodiment is similar to the first embodiment mentioned above. But the difference is that in this embodiment, the wire-stopping board 12*b* of the fan module 1*b* pivots on a pivot S at the fastening portion 115*b*. In details, corresponding through holes are formed respectively on the wire-stopping board 12*b* and the fastening portion 115*b*, so the pivot S can pass through these through holes and the wire-stopping board 12*b* and the fastening portion 115*b* are pivoted on it. As a result, the wire-stopping board 12*b* may be opened or closed with respect to the pivot S as the axis, and it is more difficult to separate the wire-stopping board 12*b* and the frame 11*b*. Alternatively, the wire-stopping board 12*b* may pivot on the pivot S at the positioning portion 116, and it is not limited thereto.

Figure 4A:
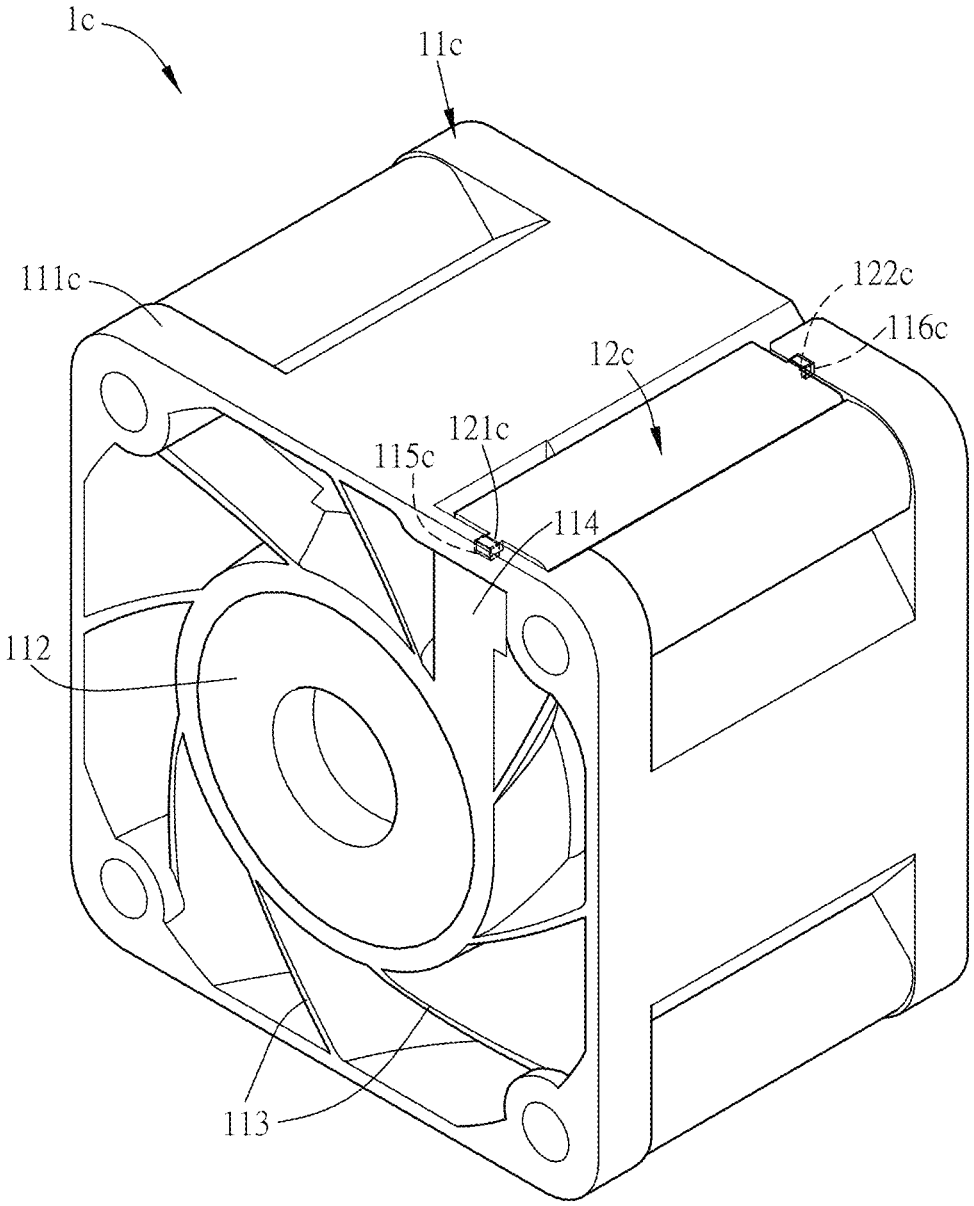
FIG. 4A is a perspective schematic diagram showing a fan module according to the fourth embodiment of the invention.
Figure 4B:
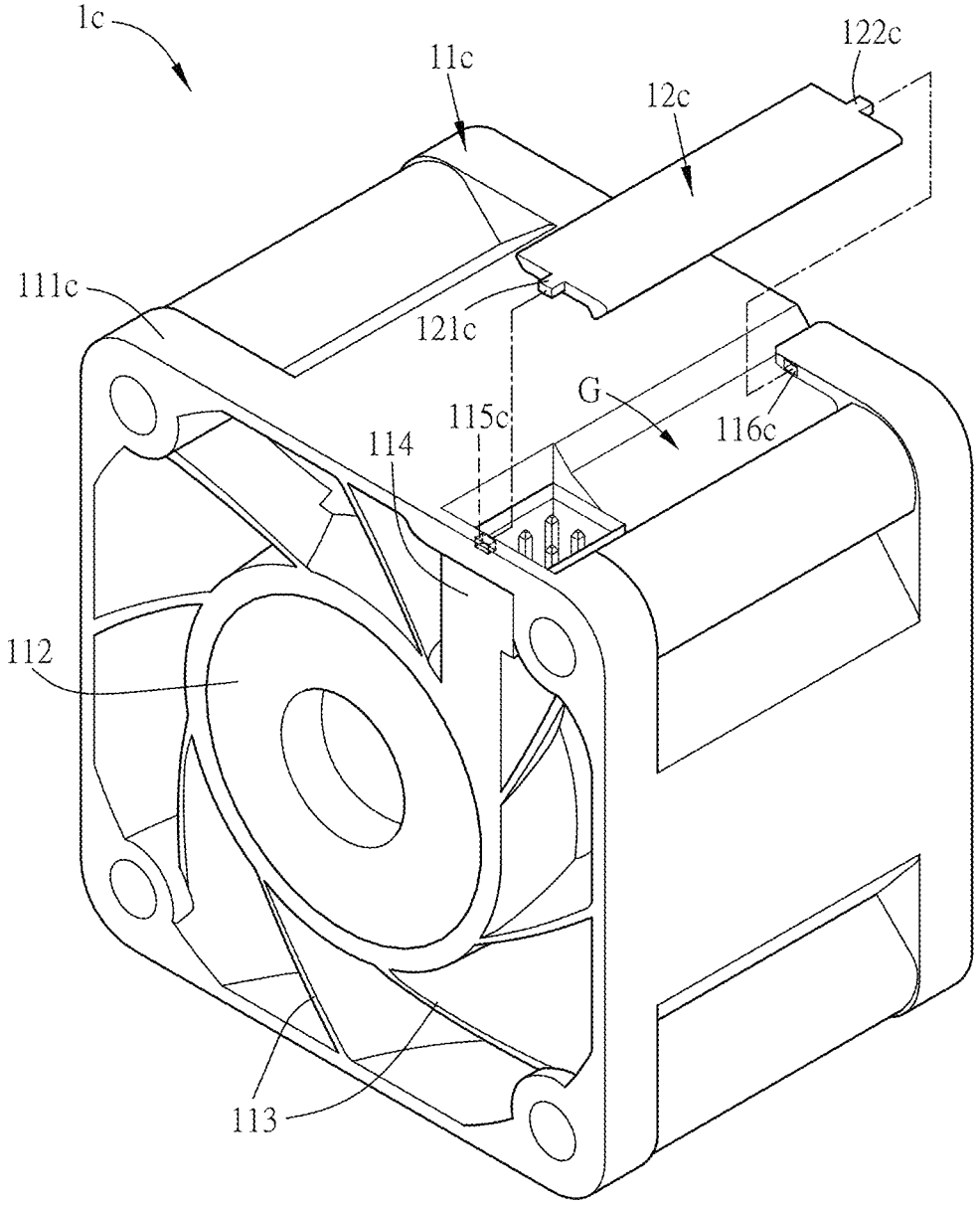
FIG. 4B is an exploded view of the fan module in FIG. 4A.

FIG. 4A is a perspective schematic diagram showing a fan module according to the fourth embodiment of the invention, and FIG. 4B is an exploded view of the fan module in FIG. 4A. Referring to FIG. 4A and FIG. 4B, the fan module 1*c* comprises the frame 11*c*, the wire-stopping board 12*c*, an impeller and a circuit board. The frame 11*c* includes a frame wall 111*c*, a base 112, a plurality of static blades 113 and a connector 114. The static blades 113 are radially connected to the base 112 and the frame wall 111*c*, and located between the base 112 and the frame wall 111*c*. A wire groove G is formed on an outside of the frame wall 111*c* to accommodate at least one wire. The connector 114 is formed on the outside of the frame wall 111*c* and extended from one end of the wire groove G to the base 112 along one of the static blades 113. Referring to FIG. 4A, this embodiment is similar to the first embodiment mentioned above. But the differences are that in this embodiment, the fastening portion 115*c* of the frame 11*c* is located at one end (which has the connector 114) of the wire groove G, and the positioning portion 116*c* of the frame 11*c* is located at the other end of the wire groove G. The fastening portion 115*c* is oppositely disposed with the positioning portion 116*c*. The fastening portion 115*c* and the positioning portion 116*c* are indentations. The first combination portion 121*c* of the wire-stopping board 12*c* is a protruding block which engages with the fastening portion 115*c*. The second combination portion 122*c* of the wire-stopping board 12*c* is a protruding block which engages with the positioning portion 116*c*. The wire-stopping board 12*c* is connected to the fastening portion 115*c* and the positioning portion 116*c* by the first combination portion 121*c* and the second combination portion 122*c* so the wire-stopping board 12*c* is located within the wire groove G and not exposed from the frame wall 111*c*. The wire in the wire groove G would not protrude from the frame wall 111*c*, so it would not interfere with external elements or wear. Thus, it is easier to install the fan module 1*c*. For the sake of clarity, the impeller and the circuit board mentioned above are not illustrated in FIG. 4A and FIG. 4B.

Figure 5A:
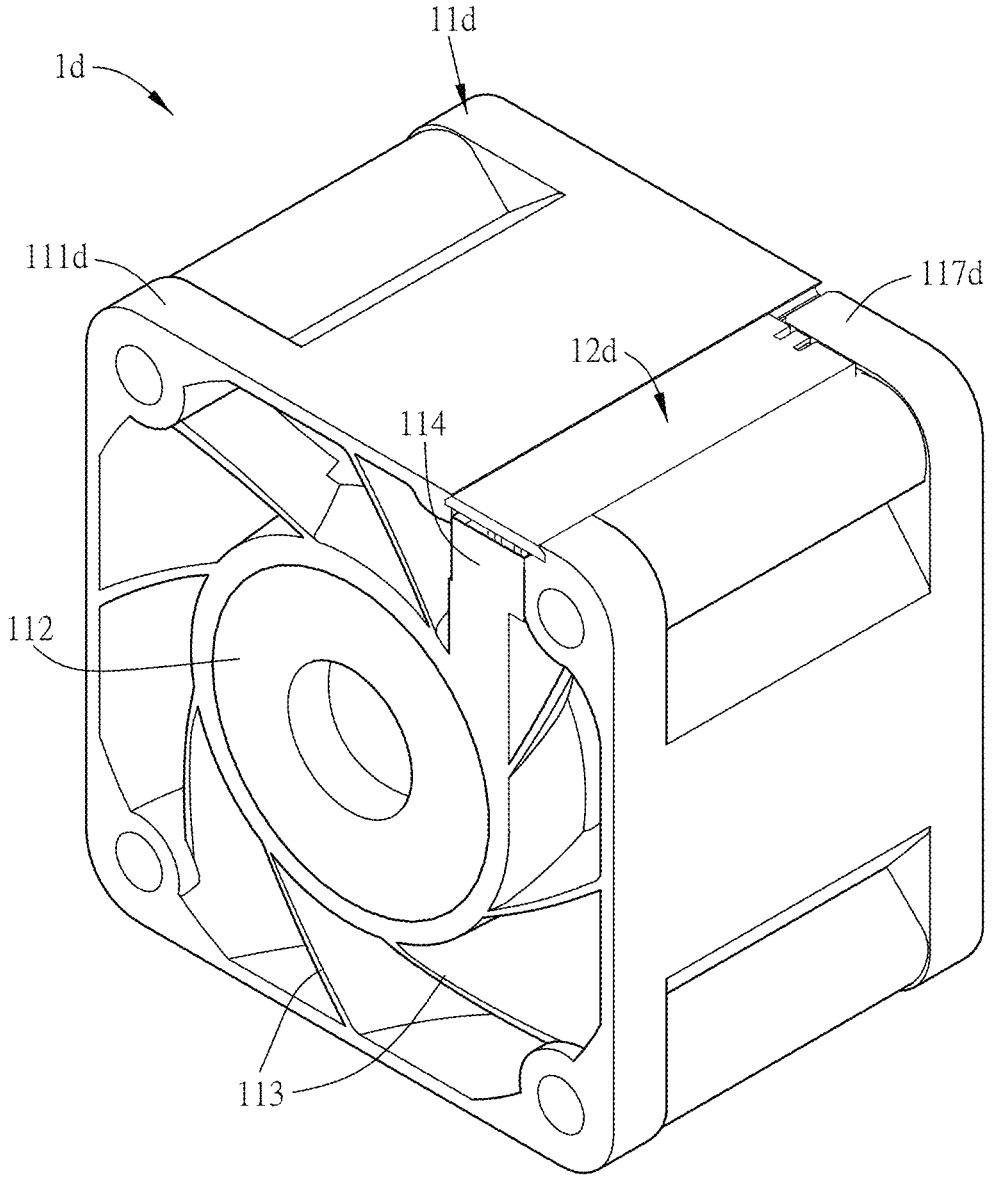
FIG. 5A is a perspective schematic diagram showing a fan module according to the fifth embodiment of the invention.
Figure 5B:
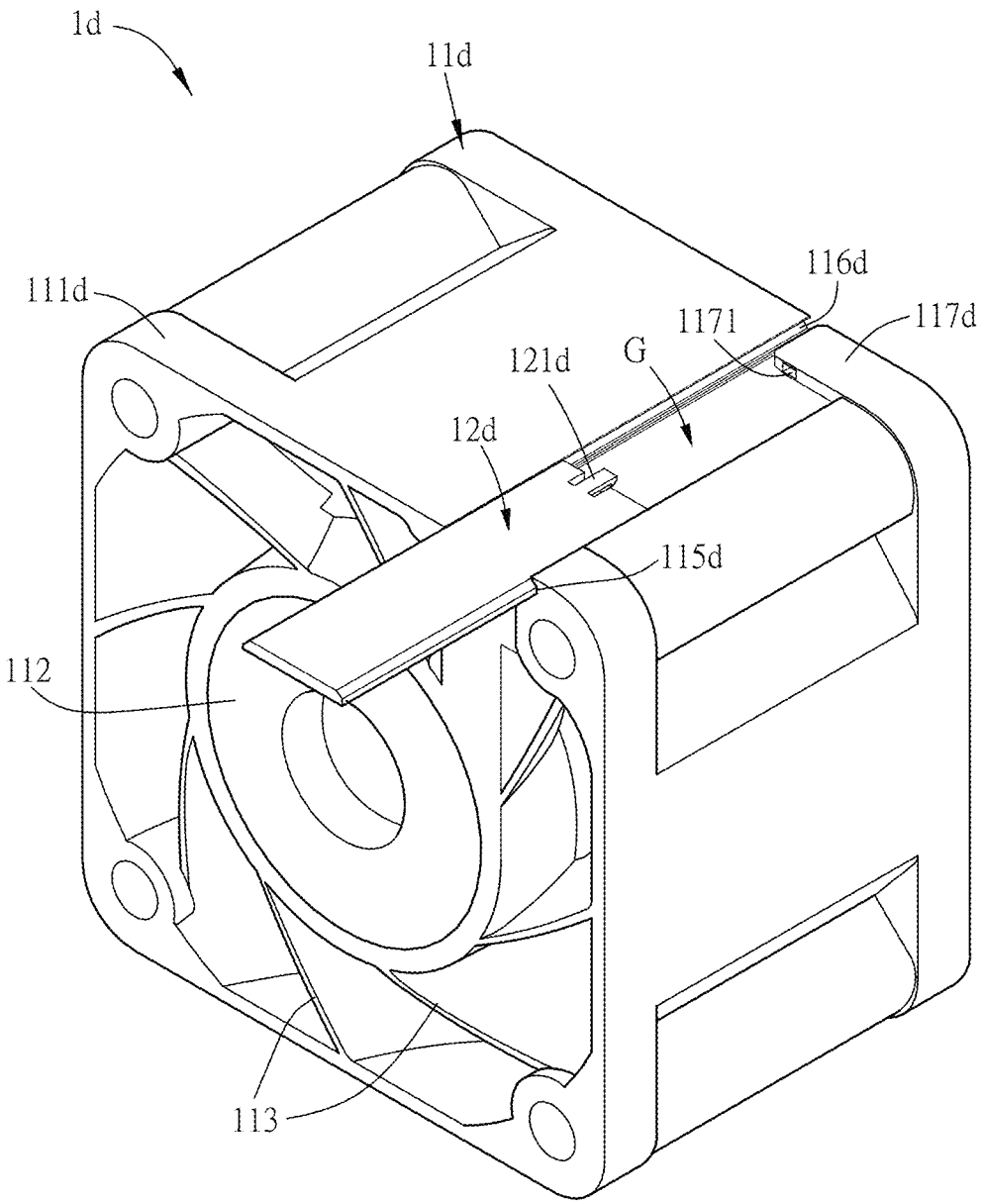
FIG. 5B is an exploded view of the fan module in FIG. 5A.

FIG. 5A is a perspective schematic diagram showing a fan module according to the fifth embodiment of the invention, and FIG. 5B is an exploded view of the fan module in FIG. 5A. Referring to FIG. 5A and FIG. 5B, the fan module 1*d* comprises the frame 11*d*, the wire-stopping board 12*d*, an impeller and a circuit board. The frame 11*d* includes a frame wall 111*d*, a base 112, a plurality of static blades 113 and a connector 114. The static blades 113 are radially connected to the base 112 and the frame wall 111*d*, and located between the base 112 and the frame wall 111*d*. A wire groove G is formed on an outside of the frame wall 111*d* to accommodate at least one wire. The connector 114 is formed on the outside of the frame wall 111*d* and extended from one end of the wire groove G to the base 112 along one of the static blades 113. Referring to FIG. 5A, this embodiment is similar to the first embodiment mentioned above. But the differences are that in this embodiment, the fastening portion 115*d* and the positioning portion 116*d* of the frame 11*d* are chutes located at opposite sides of the wire groove G and the wire-stopping board 12*d* slides in these chutes (the fastening portion 115*d* and the positioning portion 116*d*), so the wire-stopping board 12*d* is held and fixed to the frame wall 111*d* and not exposed from the frame wall 111*d*. Thus, the wire in the wire groove G would not protrude from the frame wall 111*d*, so it would not interfere with external elements or wear. Thus, it is easier to install the fan module 1*d*. For the sake of clarity, the impeller and the circuit board mentioned above are not illustrated in FIG. 5A and FIG. 5B.

In this embodiment, the frame 11*d* may further include a wire-guiding structure 117*d* which leads the wire into the wire groove G or leads the wire out of the wire groove G. The wire-guiding structure 117*d* is disposed at the other end of the wire groove G. The other end of the wire groove G is opposite to the one end which formed the connector 114. The wire-guiding structure 117*d* may further formed an indentation 1171. The wire-stopping board 12*d* may further includes a protruding block 121*d* corresponding to the indentation 1171. After the wire-stopping board 12*d* slides in the chutes (the fastening portion 115*d* and the positioning portion 116*d*), the wire-stopping board 12*d* further held and fixed to the frame wall 111*c* by the combination of the indentation 1171 and the protruding block 121*d*.

Figure 6:
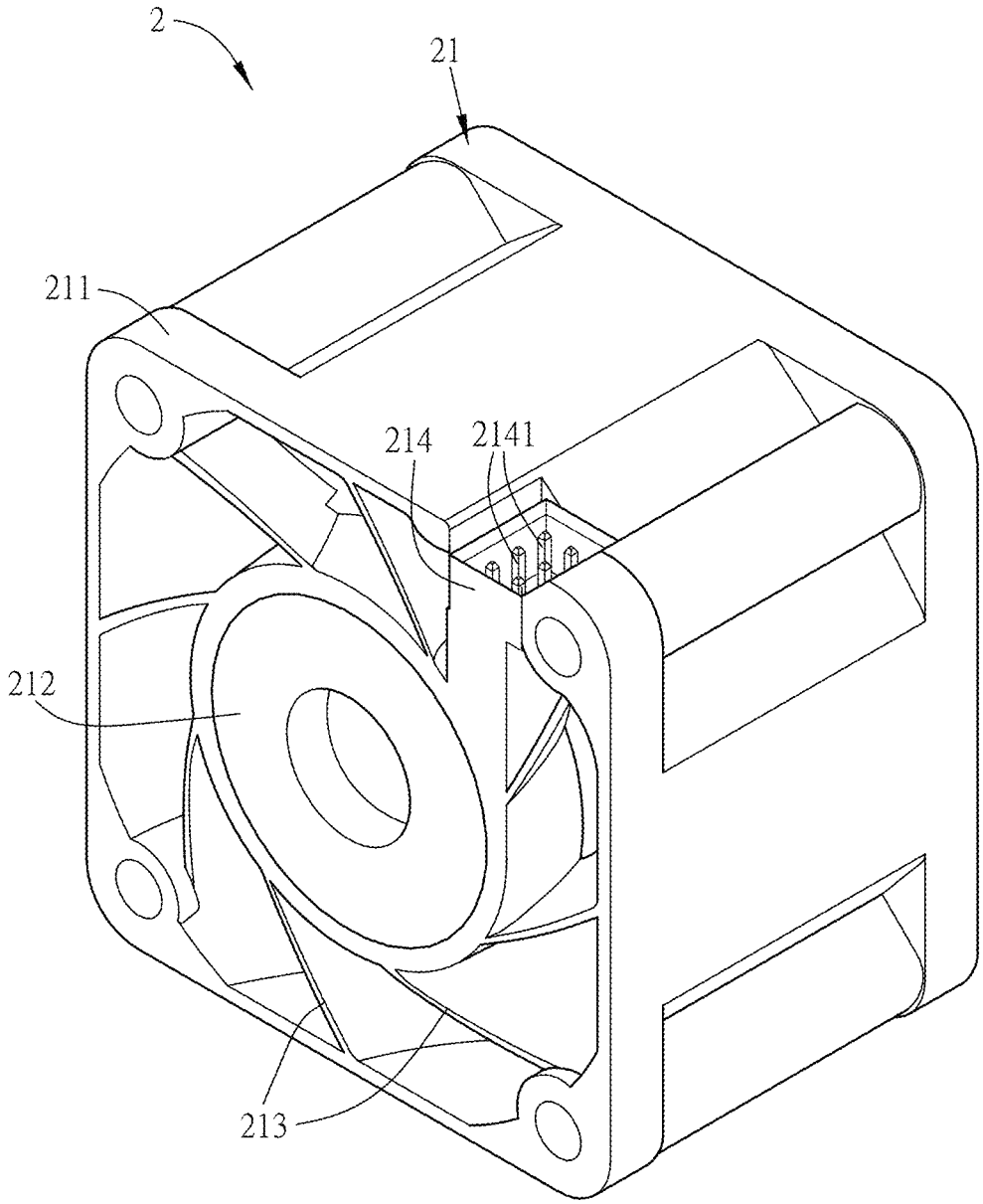
FIG. 6 is a perspective schematic diagram showing a fan module according to the sixth embodiment of the invention.

Referring to FIG. 6, FIG. 6 is a perspective schematic diagram showing a fan module according to the sixth embodiment of the invention. In this embodiment, the fan module 2 comprises a frame 21, an impeller and a circuit board. The frame 21 includes a frame wall 211, a base 212, a plurality of static blades 213 and a connector 214. The static blades 213 are radially connected to the base 212 and the frame wall 211, and located between the base 212 and the frame wall 211. The connector 214 is formed on the outside of the frame wall 211 and extended from the frame wall 211 to the base 212 along one of the static blades 213. The connector 214 includes a plurality of pins 2141. The pins 2141 are exposed out of the frame 21 to facilitate the connection with the terminals of the wires. The impeller is disposed in the frame 21. The circuit board (not shown, please refer to FIG. 1C and FIG. 1D, the circuit board 14 and the pin holes 141) is disposed in the frame 21 and located on the base 212. The circuit board includes a plurality of pin holes, the pin holes are electrically connected to the pins 2141. In this embodiment, a shape of the circuit board is corresponding to a shape of the base (refers to FIG. 1D, the circuit board 14). In another embodiment, the shape of the circuit board is corresponding to the shape of the base, and the circuit board further includes a protruding portion (refers to FIG. 1E, the circuit board 14' and the protruding portion 142). The protruding portion is corresponding to the static blade 213 which the connector 214 is extended along, and the pin holes are located at the protruding portion. The pin holes and the pins 2141 are electrically connected by, for example but not limited to, directly contacting, or welding. Because the technique features and the mutual relationships of the circuit board, the base and the connector have been descripted in the previous embodiments, they are not repeated here.

It is noted that in all embodiments, the variation of each element, component or unit could be mutually applied to any embodiments, and they are not only limited to the embodiments mentioned above.

Figure 7:
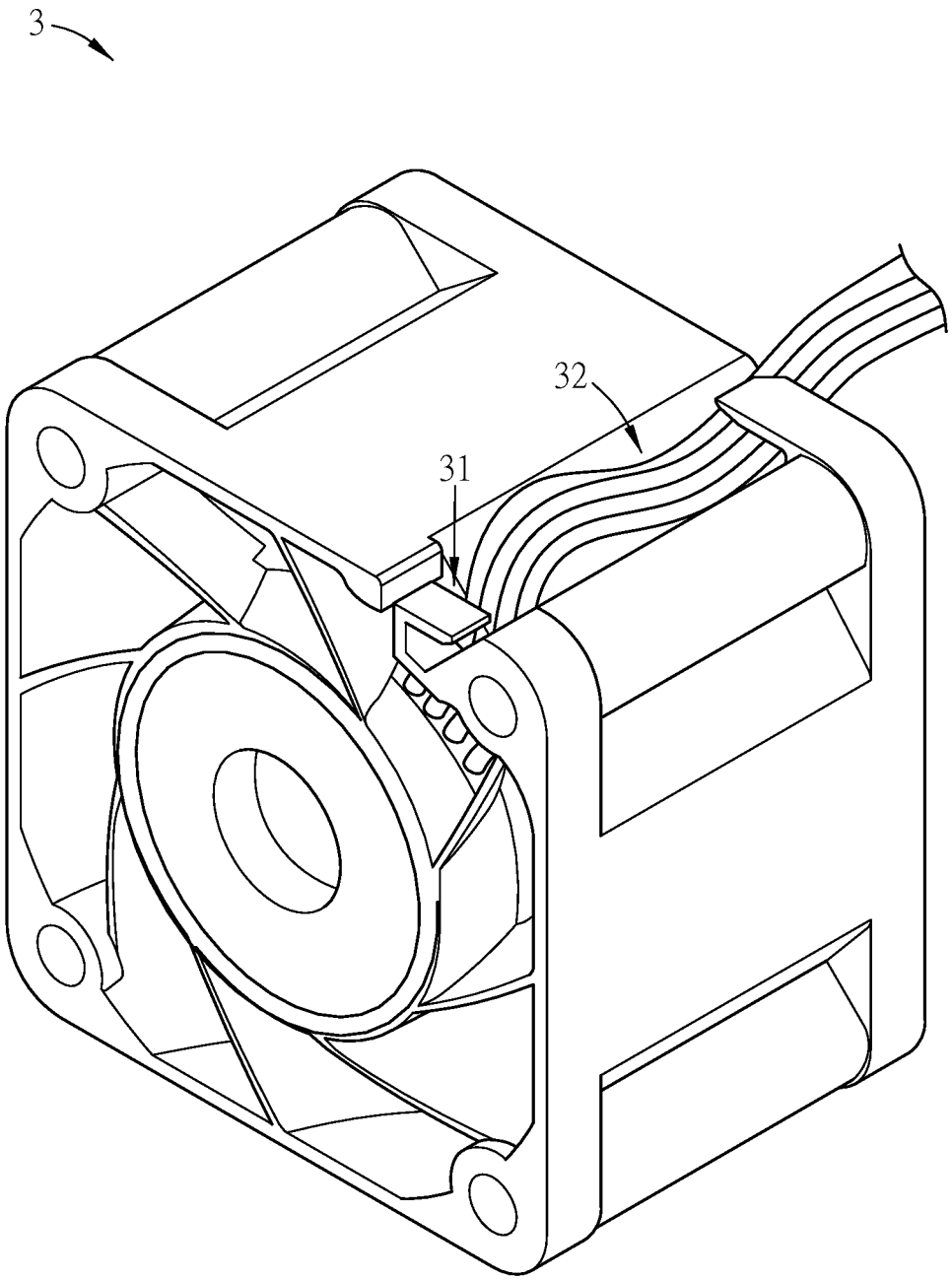
FIG. 7 (Prior Art)
FIG. 7 is a schematic diagram showing the fan module according to conventional technique.

In summary, please refer to FIG. 7 which shows the conventional fan module 3, the welding wires should be arranged manually to pass through the wire-arrangement groove 31 of the frame, welding to the pads of the circuit board manually and then arranging in the wire groove 32 manually. Compared to the conventional fan module, the fan module in this invention disposes a plurality of pin holes of the circuit board and a plurality of pins of the connector instead of the pads of the circuit board and the welding wires in the conventional fan module. Therefore, as to the fan module of this invention, because the connector is directly formed on the outside of the frame wall and electrically connected to the pin holes of the circuit board by the pins, the wires do not have to be welded to the circuit board and then arranging to pass through the frame manually. Thus, the arrangement of the wires would be easier than the conventional fan module. Moreover, the wire-stopping board covers the wire groove of the frame, so as to the wire in the wire groove would not protrude from the frame wall. Thus, the wire would not interfere with external elements or wear, and it is easier to install the fan module. In some embodiments, the wire-stopping board may further cover and shield the connector of the frame so as to avoid the air leak occurring in the connector and improve characteristics of the air pressure and air volume. Further, the manufacturing process and the testing process of the fan module in this invention could be automatically and decreasing the cost.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan module, comprising:

a frame, includes:

a frame wall includes a wire groove formed on an outside of the frame wall to accommodate a wire;

a base;

a plurality of static blades, radially connected to the base and the frame wall, and located between the base and the frame wall; and a connector, formed on the outside of the frame wall and extended from one end of the wire groove to the base along one of the static blades, the connector includes a plurality of pins;

a wire-stopping board, fixed to the frame wall to cover the wire groove;

an impeller, disposed in the frame; and a circuit board, disposed in the frame and located on the base, wherein the circuit board includes a plurality of pin holes, the pin holes are electrically connected to the pins by welding, wherein the frame wall, the base, the static blades and the connector are integrally formed as a single piece unitary structure, wherein the circuit board further includes a protruding portion, the pin holes are located at the protruding portion, an extension direction of the protruding portion is perpendicular to the frame wall and an extension direction of the wire groove.

2. The fan module of claim 1, wherein a shape of the circuit board is corresponding to a shape of the base.

3. The fan module of claim 2, wherein the protruding portion is corresponding to the static blade which the connector is extended along.

4. The fan module of claim 1, wherein the frame further includes:

a fastening portion, disposed on one side of the wire groove; and a positioning portion, disposed on the other side of the wire groove.

5. The fan module of claim 1, wherein the frame further includes:

a fastening portion, disposed on one end of the wire groove; and a positioning portion, disposed on the other end of the wire groove.

6. The fan module of claim 4, wherein the wire-stopping board includes:

a first combination portion, engaged with the fastening portion; and a second combination portion, engaged with the positioning portions.

7. The fan module of claim 6, wherein the fastening portion and the positioning portion are protruding blocks, and the first combination portion and the second combination portion are indentations.

8. The fan module of claim 6, wherein the fastening portion and the positioning portion are interlaced disposed.

9. The fan module of claim 5, wherein the wire-stopping board includes:

a first combination portion, engaged with the fastening portion; and a second combination portion, engaged with the positioning portions.

10. The fan module of claim 9, wherein the fastening portion and the positioning portion are indentations, and the first combination portion and the second combination portion are protruding blocks.

11. The fan module of claim 9, wherein the fastening portion is oppositely disposed with the positioning portion.

12. The fan module of claim 4, wherein the wire-stopping board pivots on a pivot at the fastening portion or the positioning portion.

13. The fan module of claim 4, wherein the fastening portion and the positioning portion are chutes or protruding blocks, the wire-stopping board is sliding to fix to the frame wall and held by the fastening portion and the positioning portion.

14. The fan module of claim 1, wherein the frame further includes a wire-guiding structure disposed at the other end of the wire groove.

* * * * *